US008633833B2

(12) United States Patent
Allen et al.

(10) Patent No.: US 8,633,833 B2
(45) Date of Patent: Jan. 21, 2014

(54) CONTROL OF TRAFFIC SIGNAL DUE TO OBSTRUCTED VIEW

(75) Inventors: James D. Allen, Apex, NC (US); Teresa L. Davis, Garner, NC (US); Douglas E. Hanthorn, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 78 days.

(21) Appl. No.: 13/455,454

(22) Filed: Apr. 25, 2012

(65) Prior Publication Data

US 2013/0285840 A1 Oct. 31, 2013

(51) Int. Cl.
*G08G 1/07* (2006.01)
*G08G 1/095* (2006.01)

(52) U.S. Cl.
USPC ..... 340/923; 340/907; 340/925

(58) Field of Classification Search
USPC ..... 340/907, 923, 925
See application file for complete search history.

(56) References Cited

U.S. PATENT DOCUMENTS

| | | | | |
|---|---|---|---|---|
| 3,587,040 | A | 6/1971 | Fathauer | |
| RE30,355 | E | 7/1980 | Coffman | |
| 4,573,049 | A | 2/1986 | Obeck | |
| 2009/0167562 | A1 | 7/2009 | Liang | |
| 2010/0171640 | A1 | 7/2010 | Delia et al. | |
| 2011/0090094 | A1 | 4/2011 | Yamada | |
| 2011/0156927 | A1 | 6/2011 | Ulmer | |
| 2013/0002451 | A1 * | 1/2013 | Chen et al. | 340/907 |
| 2013/0049990 | A1 * | 2/2013 | Shi et al. | 340/907 |
| 2013/0049993 | A1 * | 2/2013 | Shi et al. | 340/928 |
| 2013/0093890 | A1 * | 4/2013 | Cunningham | 348/148 |

FOREIGN PATENT DOCUMENTS

| | | | |
|---|---|---|---|
| CN | 101540108 | A | 9/2009 |
| JP | 2001010576 | A | 4/2001 |
| JP | 2004318789 | A | 1/2012 |
| WO | WO2011089324 | | 7/2011 |

* cited by examiner

*Primary Examiner* — Travis Hunnings
(74) *Attorney, Agent, or Firm* — Patrick J. Daugherty; Driggs, Hogg, Daugherty & Del Zoppo Co., LPA

(57) ABSTRACT

Traffic signal timing may be altered as a function of determining occluded signal viewing. More particularly, processing units may determine that a view of a traffic signal by a person is obstructed by a large vehicle located on a first ingress path to a roadway intersection with a second ingress path. The traffic signal controls the right of way of the first ingress path, and the person with the obstructed view is travelling along the first ingress path toward the intersection and is located behind the large vehicle relative to a view sightline of the person to the traffic signal. In response to the occluded view determination, a transition of the traffic signal may be delayed from a current visual display of a proceed signal to a subsequent visual display of a stop signal, until an end of a delay period.

20 Claims, 2 Drawing Sheets

CONTROL OF TRAFFIC SIGNAL DUE TO OBSTRUCTED VIEW

TECHNICAL FIELD OF THE INVENTION

Embodiments of the present invention relate to methods and systems for controlling and adjusting traffic light timing, and more particularly dynamically controlling and adjusting timing of a traffic light based on determining obstructed viewing of the signals by persons currently utilizing the signal.

BACKGROUND

Traffic light signaling sequences or phases are generally controlled by computers or other adjustable or programmable devices that time signaling according to specific schedules. The schedules are designed or selected to accommodate an anticipated traffic flow pattern of vehicles through an associated shared roadway portion, and thereby ensure that vehicles or pedestrians will complete travelling through the shared roadway portion before right of way is granted to another lane or ingress portion, to prevent vehicle collisions, gridlock, etc. Accordingly, transition timing from green through yellow to red light signals within such schedules generally contemplates an anticipated speed of the moving vehicles or pedestrians in order to assure that they will either have time to stop prior to entering, or to clear an affected roadway portion, prior to the signal turning red. For example, the total time to transition from green to red is generally longer on major roads with higher speed limits. Faster moving vehicles need longer stopping distance and lead times, and often may not have enough time or available stopping distance to be able to stop in time to prevent entering an intersection, but must instead proceed through an intersection upon recognizing a yellow signal. Providing for a longer yellow light time period, or otherwise a delayed transition time to red, relative to the same periods given to low-traffic, slower speed limit roadways, thereby allows such vehicles to clear the intersection before another lane is given a right-of-way through a new green signal.

Such timing patterns may be fixed and based on speed limits and anticipated traffic patterns. Different fixed timings may be scheduled, for example selecting one from a plurality of pre-determined timings for low traffic periods, and another different one during rush hour or other time periods with known heavier traffic patterns that provide different signaling for slower vehicle movements due to heavier roadway loading. Timing patterns may also be dynamically controlled, altering fixed traffic signal timing patterns in response to inputs from automobile and traffic flow sensors, such as via real-time inputs from roadway detectors or automated camera system apparatus that enable real-time observations and inferences of overall roadway or intersection loading via vehicle presence detection. For example, observing an extraordinarily large number of automobiles waiting at an intersection in front of a red light, or observing that vehicles are not moving through an intersection, may result in a signal to a traffic signal controller to effect a change in the fixed traffic signal timing pattern to help clear the roadway or intersection. However, differentiated signal timing may be ineffective in relieving other traffic flow impacts and problems beyond routine heavy traffic incidents.

BRIEF SUMMARY

In one embodiment of the present invention, a method for altering traffic signal timing as a function of occluded signal viewing includes determining via a processing unit that a view of a traffic signal by a person is obstructed by a large vehicle located on a first ingress path to a roadway intersection with a second ingress path. The traffic signal controls the right of way of the first ingress path, and the person with the obstructed view is travelling along the first ingress path toward the intersection and is located behind the large vehicle relative to a view sightline of the person to the traffic signal. In response to the occluded view determination, a transition of the traffic signal is delayed for a delay period from a current visual display of a proceed signal to the person to a subsequent visual display of a stop signal to the person. The proceed signal visually conveys to the person via the view sightline that the person has right of way through the intersection, and the stop signal visually conveys via said view sightline that the person must stop from proceeding into or through the intersection. Thus, the traffic signal is transitioned from visually displaying the proceed signal to visually displaying the stop signal to the person via the view sightline at an end of the delay period.

In another embodiment, a system has a processing unit, computer readable memory and a tangible computer-readable storage medium with program instructions. The processing unit, when executing the stored program instructions, determines that a view of a traffic signal by a person is obstructed by a large vehicle located on a first ingress path to a roadway intersection with a second ingress path. The traffic signal controls the right of way of the first ingress path, and the person with the obstructed view is travelling along the first ingress path toward the intersection and is located behind the large vehicle relative to a view sightline of the person to the traffic signal. In response to the occluded view determination, a transition of the traffic signal is delayed for a delay period from a current visual display of a proceed signal to the person to a subsequent visual display of a stop signal to the person. The proceed signal visually conveys to the person via the view sightline that the person has right of way through the intersection, and the stop signal visually conveys via said view sightline that the person must stop from proceeding into or through the intersection. Thus, the traffic signal is transitioned from visually displaying the proceed signal to visually displaying the stop signal to the person via the view sightline at an end of the delay period.

In another embodiment, an article of manufacture has a tangible computer-readable storage medium with computer readable program code embodied therewith. The computer readable program code comprises instructions that, when executed by a computer processing unit, cause the computer processing unit to determine that a view of a traffic signal by a person is obstructed by a large vehicle located on a first ingress path to a roadway intersection with a second ingress path. The traffic signal controls the right of way of the first ingress path, and the person with the obstructed view is travelling along the first ingress path toward the intersection and is located behind the large vehicle relative to a view sightline of the person to the traffic signal. In response to the occluded view determination, a transition of the traffic signal is delayed for a delay period from a current visual display of a proceed signal to the person to a subsequent visual display of a stop signal to the person. The proceed signal visually conveys to the person via the view sightline that the person has right of way through the intersection, and the stop signal visually conveys via said view sightline that the person must stop from proceeding into or through the intersection. Thus, the traffic signal is transitioned from visually displaying the proceed signal to visually displaying the stop signal to the person via the view sightline at an end of the delay period.

BRIEF DESCRIPTION OF THE SEVERAL VIEWS OF THE DRAWINGS

These and other features of this invention will be more readily understood from the following detailed description of the various aspects of the invention taken in conjunction with the accompanying drawings in which.

Figure 1:
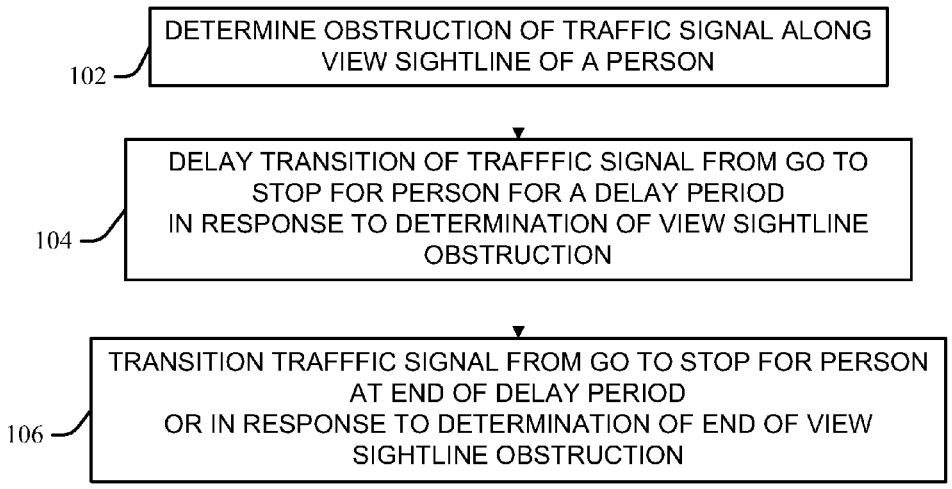
FIG. 1 is a block diagram illustration of an embodiment of a method, process or system for altering traffic signal timing as a function of occluded signal viewing according to the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied therein, for example, in a baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including, but not limited to, wireless, wireline, optical fiber cable, RF, etc., or any suitable combination of the foregoing.

Computer program code for carrying out operations for aspects of the present invention may be written in any combination of one or more programming languages, including an object oriented programming language such as Java®, Smalltalk, C++ or the like and conventional procedural programming languages, such as the "C" programming language or similar programming languages. (Java and all Java-based trademarks and logos are trademarks or registered trademarks of Oracle and/or its affiliates.) The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

With respect to traffic control signaling products and services, merely determining the presence or amount of traffic may not enable such systems to predict or infer actual traffic reactions in response to traffic light signals. Pedestrians and vehicle operators may fail to see or recognize changing traffic signals in a timely manner, via distractions or actual occluding obstructions. Accordingly, a signal timing otherwise adequate in meeting observed traffic loading might actually result in a person unwittingly entering a roadway portion after the signal has already terminated their right of way, which may result in a traffic rule infraction, gridlock in an intersection, or even a collision with another vehicle that may result in casualty or property damage losses.

FIG. 1 illustrates an embodiment of a method, system or process of the present invention for altering traffic signal timing as a function of occluded signal viewing. At 102, a traffic signal controller determines that the view of a traffic signal that controls the right of way of a first ingress path is obstructed by a large vehicle. "Ingress path" is a generic term that comprehends roadway lanes of vehicular traffic (automobile, bicycle, horse-drawn carriage, etc.), as well as pedestrian sidewalks, crosswalks, differentiated bike lanes, etc. A large vehicle is one that is taller than the height of the person, for example taller than the height of a standing pedestrian, or taller than the height of a person seated in a vehicle or on a bicycle.

More particularly, the obstructed view is of one or more vehicle operators, pedestrians or other persons utilizing the first ingress path or other associated pathway or lane in conjunction with the right of the way of the first ingress path, such as a sidewalk adjacent to a roadway lane comprising the large vehicle (truck, bus, etc.) and that provides ingress to an intersection with another, second roadway via a crosswalk across the second roadway. Thus, in some embodiments, the transition of the traffic signal may be delayed until a person crosses the second roadway via the crosswalk.

The obstruction determined at 102 is one likely to occlude the viewing of right-of-way light signals on the traffic signal that are relevant to entry into and passage through an intersection with other ingress paths. For example, the obstruction may prevent persons from seeing one or more of the red, yellow or green lights on the traffic signal while they are entering or traversing areas impacting the associated vehicle roadway from the first ingress path. Accordingly, they are likely to enter the associated vehicle roadway under a mistaken assumption that they have the right-of-way as the traffic signal light is green, when in fact it would have turned yellow or red prior to their entry, and thus they no longer have the right of way and should instead have stopped. The occluded view prevents them from receiving this information from the traffic signal.

The traffic signal controller may be a human monitor, or it may be a processing unit of a programmable device that is configured by code instructions. In response to the occluded view determination at 102, at 104 the traffic signal controller delays transition of a signal of granted right of way to the first lane person or persons with the occluded view (a "go" signal, commonly a green light) to a "stop" signal (commonly a red light) that revokes their right of way. The delay at 104 may be a delay period selected to have a length of the period sufficient to enable said person or persons to continue through and vacate a portion of the roadway shared by another, second lane of traffic, wherein their presence would otherwise impact the right of way of those entering from the second lane. More particularly, the impacted others comprise vehicle operators, pedestrians or other persons entering the shared portion via the second lane of ingress that is also controlled by the signal and generally given a green light (permission to enter) when the first lane comprising the occluded-view persons has a red, and vice versa.

At 106, at the end of a delayed transition period selected or determined at 104, or upon confirmation at 104 that said person or persons have in fact completed their transit, the traffic signal controller allows or instigates a transition of the traffic signal to red (or to any other "stop" signal) for the first lane of the persons with the occluded views, and to green for the second lane of impacted others.

Delaying the transition at 104 and then transitioning to red at 106 may comprise selecting and adding an additional, predetermined time period to a transition period used by a current signal schedule. For example, possible scenarios may be identified for the observed view occlusion with respect to each of different pedestrian or vehicle movements, and time periods estimated for each that will enable said persons to compete their travels through the impacted right of way. Thus, an additional time period may be selected and utilized at 104/106 as a longest of such estimated time periods.

An additional time period might also be selected at 104 to meet a minimum requirement, one that may be shorter than a longest possible scenario time, but that meets a specific criteria. For example, one may be selected that meets a majority of possible scenarios of time needs, a most likely time need, or a certain scenario time need that is required to be met by regulation standard, etc. Thus, a threshold may be used to select a predetermined period that is not the longest possible in time, thereby reducing impact on the normal traffic signaling, reducing delays impacting traffic flow into and through the shared portion by the second ingress path, or avoiding gridlock creation, etc.

The delay implemented at 104/106 may also be determined dynamically. For example, an extent of the actual view occlusion may be determined in real time by sensors. Thus, the transition of the traffic signal may be delayed in real time to a point at which the occlusion is no longer detected, or wherein those viewing the signal from the first ingress path will have enough time to react and stop before entering the shared portions. In some embodiments, an additional tolerance time period may also be added to enable persons to react and stop, or to complete their travels through the impacted right of way.

Figure 2:
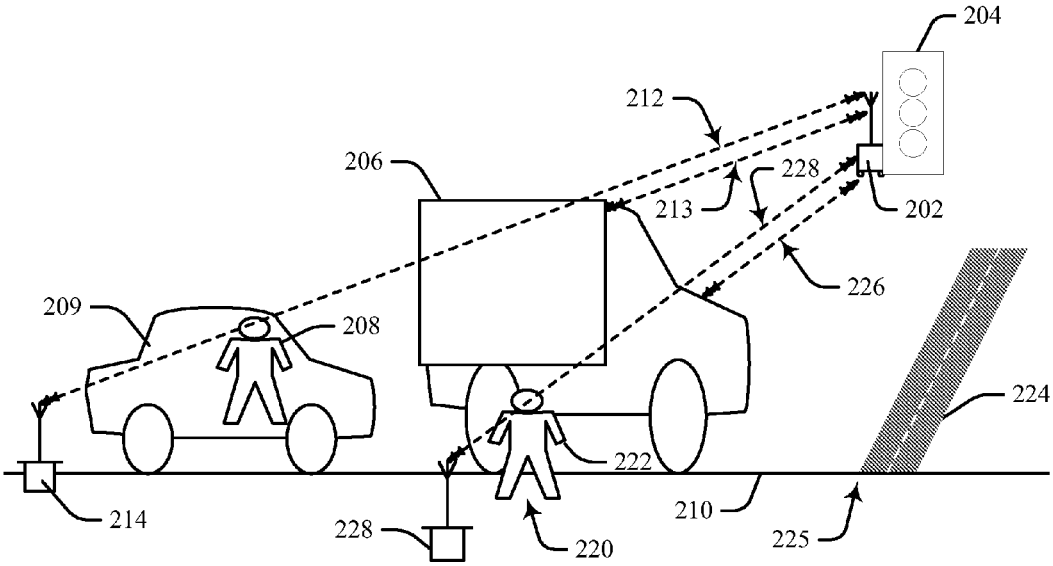
FIG. 2 is a diagrammatic illustration of an embodiment of the present invention.

FIG. 2 illustrates one embodiment of the present invention wherein a height or motion sensor 202 attached to (or incorporated into) a traffic signal 204 determines when a truck or other tall or large vehicle 206 obstructs the view of a vehicle operator 208 located in a vehicle 209 that is in a first lane 210 of vehicular traffic in common with the truck 206 and located behind the truck 206 relative to the signal 204. Thus, as discussed with respect to FIG. 1 above, a change in light status for the signal 204 is delayed for some period of time to permit the following vehicle 209 to clear the intersection 225, or to stop before entering the intersection 225.

The obstruction may be determined as a function of a line of sight 212 from the traffic signal 204 to the occluded-view operator 208. For example, waves refracted back 213 to the sensor 202 by the truck 206 (for example, light, radio or sound waves) may indicate to the sensor 202 the presence of the obstructing truck 206, wherein obstruction of vision of the signal 204 along the line of sight 212 may be inferred. A roadside sensor 214 may also be utilized, one that is aligned (for example, in a common plane or other geometric relationship commonality) with an expected position of the following vehicle 208 with respect to the presence of any large truck/vehicle 206. Thus, if the line of sight 212 between the traffic signal sensor 202 and the roadside sensor 214 is occluded (for example, a light beam or other line-of-sight signal communication between the two is interrupted or broken, as in an electric-eye relationship), then occlusion of the view of the following vehicle 208 may be assumed or inferred. Accordingly, the signal transition may be delayed, in one aspect enabling the following vehicle 208 to safely complete a traversal of the intersection 225.

Embodiments may also sense or infer signal view obstructions with respect to pedestrians. For example, the line-of-sight view 228 of the traffic signal 204 by a pedestrian 222 from a sidewalk location 220 adjacent to the truck 206 may be obstructed by the truck 206. Thus, such pedestrian 222 may erroneously assume that he or she still has the right of way to cross an intersecting roadway 224 at the intersection 225 after the truck 206 proceeds along the road 210, where in fact the light has already changed. Thus, according to the present invention, the sensor may also monitor the pedestrian line-of-sight 226, for example via electromagnetic or other waves 226 refracted back to the sensor 202 by a surface of the truck 206 along said line of sight 228. A roadside sensor 228 may also be utilized that is aligned with the line of sight 226 of the sidewalk position 220 of the pedestrian 222, wherein if a line-of-sight signal communication between with the signal sensor 202 is interrupted or broken, occlusion of the view of the pedestrian 222 may be assumed or inferred. Accordingly, the signal transition may be delayed, in one aspect enabling the adjacent person 222 to safely complete a traversal of the intersection 225. In the present example, the adjacent person 222 is a pedestrian, but he or she may also be a vehicle in an adjacent lane, upon a bicycle in an adjacent bike lane, etc.

The sensors may also use more general, non-directional sensing procedures and reactions thereto. For example, merely detecting the presence of the large truck 206 of a given height by the sensor 202 in a close proximity to the traffic signal 204 may lead to an assumption that someone's view is likely to be occluded, independent of determining any particular line of sight. The presence of the obstructing vehicle may be determined via a variety of systems and apparatuses. For example, a blockage of sunlight to a roadside light sensor 214 or 228, wherein vehicles of low or standard (threshold) automobile heights would not block the light, may lead to an assumption that someone's view is likely occluded by a vehicle 206 on the roadway 210 just before the intersection 225, independent of determining any particular line of sight. It will be apparent to one skilled in the art that the locations and settings of the sensor 202 or any associated components 214/228 may be dependent on the configuration of a given intersection 225, roadway 210/224, traffic signal 202, etc., and the present invention is not limited to the illustrative embodiments described herein.

As discussed above with respect to FIG. 1, embodiments may automatically delay the signal 202 transition for a selected, predetermined or default duration in response to a large vehicle presence detection. The delay implemented may also be determined dynamically. In the present example, the transition of the traffic signal may be delayed in real time to a point at which signal communication by the signal sensor 202 with either or both of the sensors 214/228 is no longer occluded, or wherein refracted/bounced signals 213 or 226 are no longer being received back by the sensor 202. In some embodiments, an additional tolerance time period may also be added to said determinations, for example to enable persons to react or complete their travels through the impacted right of way.

Figure 3:
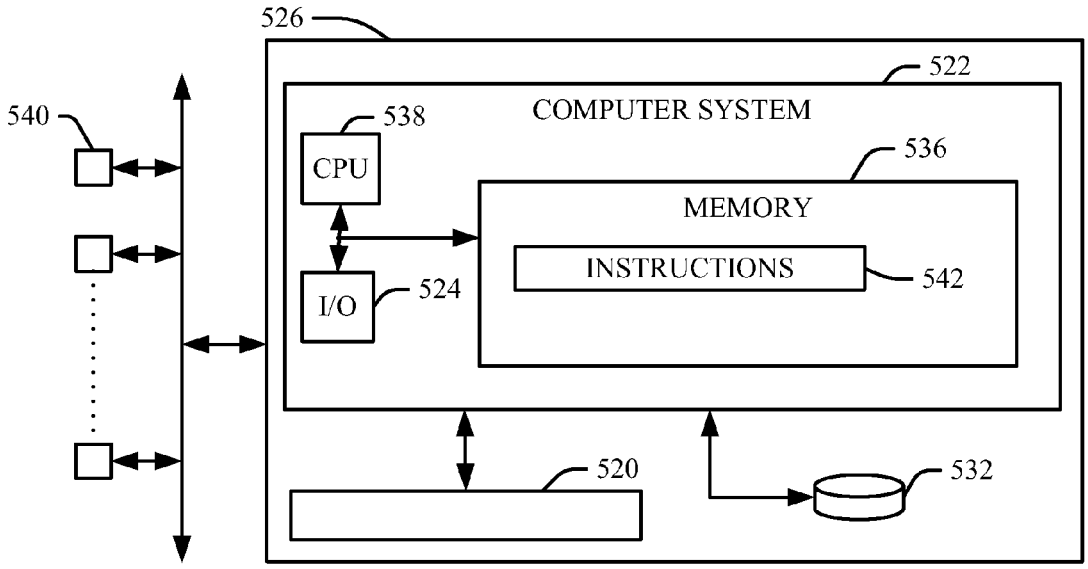
FIG. 3 is a block diagram illustration of a computerized implementation of an embodiment of the present invention.

Referring now to FIG. 3, an exemplary computerized implementation of an embodiment of the present invention includes a computer system or other programmable device 522 in communication with sensors 540 that provide data regarding the obstructed viewing of traffic signals. Instructions 542 reside within computer readable code in a computer readable memory 536, or in a computer readable storage system 532, or other tangible computer readable storage medium that is accessed through a computer network infrastructure 526 by a processing unit (CPU) 538 or input/output (I/O) device 524. Thus, the instructions, when implemented by the processing unit (CPU) 538, cause the processing unit (CPU) 538 to alter traffic signal timing as a function of occluded signal viewing as described above with respect to FIGS. 1 and 2.

Embodiments of the present invention may also perform process steps of the invention on a subscription, advertising, and/or fee basis. That is, a service provider could offer to integrate computer-readable program code into the computer system 522 to enable the computer system 522 to alter traffic signal timing as a function of occluded signal viewing as described above with respect to FIGS. 1-3. The service provider can create, maintain, and support, etc., a computer infrastructure such as the computer system 522, network environment 526, or parts thereof, that perform the process steps of the invention for one or more customers. In return, the service provider can receive payment from the customer(s) under a subscription and/or fee agreement and/or the service provider can receive payment from the sale of advertising content to one or more third parties. Services may comprise one or more of: (1) installing program code on a computing device, such as the computer device 522, from a tangible computer-readable medium device 520 or 532; (2) adding one or more computing devices to a computer infrastructure; and (3) incorporating and/or modifying one or more existing systems of the computer infrastructure to enable the computer infrastructure to perform the process steps of the invention.

The terminology used herein is for describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising" when used in this specification, specify the presence of stated features, integers, steps, operations, elements, and/or components, but do not preclude the presence or addition of one or more other features, integers, steps, operations, elements, components, and/or groups thereof. Certain examples and elements described in the present specification, including in the claims and as illustrated in the Figures, may be distinguished or otherwise identified from others by unique adjectives (e.g. a "first" element distinguished from another "second" or "third" of a plurality of elements, a "primary" distinguished from a "secondary" one or "another" item, etc.) Such identifying adjectives are generally used to reduce confusion or uncertainty, and are not to be construed to limit the claims to any specific illustrated element or embodiment, or to imply any precedence, ordering or ranking of any claim elements, limitations or process steps.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method for altering traffic signal timing as a function of occluded signal viewing, the method comprising:

determining via a processing unit that a view of a traffic signal by a person is obstructed by a large vehicle located on a first ingress path to a roadway intersection with a second ingress path, wherein the traffic signal controls the right of way of the first ingress path, and wherein the person is travelling along the first ingress path toward the intersection and is located behind the large vehicle relative to a view sightline of the person to the traffic signal;

in response to the occluded view determination, delaying a transition of the traffic signal for a delay period from a current visual display of a proceed signal to the person to a subsequent visual display of a stop signal to the person, wherein the current proceed signal visually conveys via the view sightline to the person that the person has right of way through the intersection, and wherein the subsequent stop signal visually conveys via the view sightline to the person that the person must stop from proceeding into or through the intersection; and transitioning the traffic signal from visually displaying the proceed signal to visually displaying the stop signal to the person via the view sightline at an end of the delay period.

2. The method of claim 1, wherein the first ingress path is a first roadway lane of vehicular traffic, wherein the person is operating a vehicle on the first roadway lane, and wherein the large vehicle is taller than a height of the person while operating the vehicle.

3. The method of claim 2, wherein the vehicle operated by the person is an automobile or a bicycle; and wherein the large vehicle is a truck or a bus.

4. The method of claim 1, wherein the first ingress path is a first roadway lane of vehicular traffic comprising an adjacent sidewalk;

wherein the second ingress path is a second roadway;

wherein the person is a pedestrian located on a sidewalk adjacent to the large vehicle;

wherein the sidewalk provides ingress to the intersection via a crosswalk across the second roadway; and wherein the step of delaying the transition of the traffic signal comprises delaying the transition of the traffic signal until the person crosses the second roadway via the crosswalk.

5. The method of claim 1, further comprising:

selecting a delay amount from at least one predetermined delay amount;

wherein the delaying the transition of the traffic signal comprises generating the delay period by adding the selected predetermined delay amount to a transition period used by a current signal schedule of the traffic signal; and wherein the end of the selected delay period is an elapse of the generated delay period.

6. The method of claim 5, wherein the step of selecting the delay amount comprises selecting a delay amount that is estimated to enable the person to complete a travel through the intersection.

7. The method of claim 6, wherein the at least one delay amount comprises a plurality of delay amounts that are each estimated to enable different pedestrians or vehicles to compete the travel through the intersection; and the method further comprising selecting a longest of the delay amounts.

8. The method of claim 1, wherein the step of delaying the transition of the traffic signal comprises initiating a delay in a transition that is scheduled in a transition period used by a current signal schedule of the traffic signal, in response to a real-time determination that the view of the traffic signal by the person via the view sightline is obstructed by the large vehicle located on the first ingress path, wherein the person is travelling along the first ingress path toward the intersection and is located behind the large vehicle relative to the traffic signal; and wherein the transitioning the traffic signal from visually displaying the proceed signal to visually displaying the stop signal to the person via the view sightline at an end of the delay period is in response to a real-time determination that the view of the traffic signal by the person via the view sightline no longer is obstructed by the large vehicle.

9. The method of claim 1, wherein the step of determining via the processing unit that the view of the traffic signal by the person is obstructed by the large vehicle located on the first ingress path is responsive to signals received by the a sensor located along the view sightline of the person to the traffic signal.

10. The method of claim 1, further comprising:

a service provider installing program code on the processing unit via a tangible computer-readable storage medium, wherein program instructions of the program code when executing on the processing unit cause the processing unit to perform each of the steps of determining that the view of the traffic signal by the person is obstructed by the large vehicle, delaying the transition of the traffic signal for the delay period, and transitioning the traffic signal from visually displaying the proceed signal to visually displaying the stop signal to the person via the view sightline at an end of the delay period.

11. A system, comprising:

a processing unit in communication with a computer readable memory and a tangible computer-readable storage medium;

wherein the processing unit is in communication with a sensor and with a traffic signal, and when executing program instructions stored on the tangible computer-readable storage medium via the computer readable memory:

determines via signals from the sensor that a view of the traffic signal by a person is obstructed by a large vehicle located on a first ingress path to a roadway intersection with a second ingress path, wherein the traffic signal controls the right of way of the first ingress path, and wherein the person is travelling along the first ingress path toward the intersection and is located behind the large vehicle relative to a view sightline of the person to the traffic signal;

in response to the occluded view determination, delays a transition of the traffic signal for a delay period from a current visual display of a proceed signal to the person to a subsequent visual display of a stop signal to the person, wherein the current proceed signal visually conveys via the view sightline to the person that the person has right of way through the intersection, and wherein the subsequent stop signal visually conveys via the view sightline to the person that the person must stop from proceeding into or through the intersection; and signals the traffic signal to transition from visually displaying the proceed signal to visually displaying the stop signal to the person via the view sightline at an end of the delay period.

12. The system of claim 11, wherein the processing unit, when executing the program instructions stored on the computer-readable storage medium via the computer readable memory, determines that the view of the traffic signal by the person is obstructed by the large vehicle located on the first ingress path in response to signals received by a sensor located along the view sightline of the person to the traffic signal.

13. The system of claim 11, wherein the first ingress path is a first roadway lane of vehicular traffic, wherein the person is operating a vehicle on the first roadway lane, and wherein the large vehicle is taller than a height of the person while operating the vehicle.

14. The system of claim 13, wherein the first ingress path is a first roadway lane of vehicular traffic comprising an adjacent sidewalk;

wherein the second ingress path is a second roadway;

wherein the person is a pedestrian located on the sidewalk and adjacent to the large vehicle;

wherein the sidewalk provides ingress to the intersection via a crosswalk across the second roadway; and wherein the processing unit, when executing the program instructions stored on the computer-readable storage medium via the computer readable memory, delays the transition of the traffic signal until the person crosses the second roadway via the crosswalk.

15. The system of claim 11, wherein the processing unit, when executing the program instructions stored on the computer-readable storage medium via the computer readable memory, further:

selects a delay amount from at least one predetermined delay amount;

delays the transition of the traffic signal by generating the delay period by adding the selected predetermined delay amount to a transition period used by a current signal schedule of the traffic signal; and ends the selected delay period at an elapse of the generated delay period.

16. The system of claim 11, wherein the processing unit, when executing the program instructions stored on the computer-readable storage medium via the computer readable memory, further:

delays the transition of the traffic signal by initiating a delay in a transition that is scheduled in a transition period used by a current signal schedule of the traffic signal, in response to a real-time sensor determination that the view of the traffic signal by the person via the view sightline is obstructed by the large vehicle located on the first ingress path, wherein the person is travelling along the first ingress path toward the intersection and is located behind the large vehicle relative to the traffic signal; and transitions the traffic signal from visually displaying the proceed signal to visually displaying the stop signal to the person via the view sightline at an end of the delay period in response to a real-time sensor determination that the view of the traffic signal by the person via the view sightline no longer is obstructed by the large vehicle.

17. An article of manufacture, comprising:

a computer readable tangible storage medium having computer readable program code embodied therewith, the computer readable program code comprising instructions that, when executed by a computer processing unit, cause the computer processing unit to:

determine via signals from the sensor that a view of the traffic signal by a person is obstructed by a large vehicle located on a first ingress path to a roadway intersection with a second ingress path, wherein the traffic signal controls the right of way of the first ingress path, and wherein the person is travelling along the first ingress path toward the intersection and is located behind the large vehicle relative to a view sightline of the person to the traffic signal;

in response to the occluded view determination, delay a transition of the traffic signal for a delay period from a current visual display of a proceed signal to the person to a subsequent visual display of a stop signal to the person, wherein the current proceed signal visually conveys via the view sightline to the person that the person has right of way through the intersection, and wherein the subsequent stop signal visually conveys via the view sightline to the person that the person must stop from proceeding into or through the intersection; and signal the traffic signal to transition from visually displaying the proceed signal to visually displaying the stop signal to the person via the view sightline at an end of the delay period.

18. The article of manufacture of claim 17, wherein the computer readable program code instructions, when executed by the computer processing unit, further cause the computer processing unit to determine that the view of the traffic signal by the person is obstructed by the large vehicle located on the first ingress path in response to signals received by a sensor located along the view sightline of the person to the traffic signal.

19. The article of manufacture of claim 17, wherein the computer readable program code instructions, when executed by the computer processing unit, further cause the computer processing unit to:

select a delay amount from at least one predetermined delay amount;

delay the transition of the traffic signal by generating the delay period by adding the selected predetermined delay amount to a transition period used by a current signal schedule of the traffic signal; and end the selected delay period at an elapse of the generated delay period.

20. The article of manufacture of claim 19, wherein the computer readable program code instructions, when executed by the computer processing unit, further cause the computer processing unit to:

delay the transition of the traffic signal by initiating a delay in a transition that is scheduled in a transition period used by a current signal schedule of the traffic signal, in response to a real-time sensor determination that the view of the traffic signal by the person via the view sightline is obstructed by the large vehicle located on the first ingress path, wherein the person is travelling along the first ingress path toward the intersection and is located behind the large vehicle relative to the traffic signal; and transition the traffic signal from visually displaying the proceed signal to visually displaying the stop signal to the person via the view sightline at an end of the delay period in response to a real-time sensor determination that the view of the traffic signal by the person via the view sightline no longer is obstructed by the large vehicle.

* * * * *